US012023544B2

(12) United States Patent
Hu

(10) Patent No.: US 12,023,544 B2
(45) Date of Patent: Jul. 2, 2024

(54) VERTICAL-COLUMN FOLDING MECHANISM FOR TREADMILL

(71) Applicant: Yongkang Saihan Electronic Technology Co.,Ltd., Jinhua (CN)

(72) Inventor: Jiachen Hu, Jinhua (CN)

(73) Assignee: Yongkang Saihan Electronic Technology Co., Ltd., Jinhua (CN)

( * ) Notice: Subject to any disclaimer, the term of this patent is extended or adjusted under 35 U.S.C. 154(b) by 159 days.

(21) Appl. No.: 17/858,121

(22) Filed: Jul. 6, 2022

(65) Prior Publication Data

US 2022/0331648 A1 Oct. 20, 2022

(30) Foreign Application Priority Data

Aug. 16, 2021 (CN) ..... 202121913517.1

(51) Int. Cl.
*A63B 21/00* (2006.01)
*A63B 22/02* (2006.01)

(52) U.S. Cl.
CPC ..... *A63B 21/4035* (2015.10); *A63B 22/02* (2013.01); *A63B 2210/50* (2013.01)

(58) Field of Classification Search
CPC ..... A63B 21/4035; A63B 2210/50; A63B 22/02–0292
See application file for complete search history.

(56) References Cited

U.S. PATENT DOCUMENTS

2004/0116255 A1* 6/2004 Chen ..... A63B 22/02 482/54
2009/0042698 A1 2/2009 Wang
2009/0069159 A1 3/2009 Wang
2011/0021323 A1* 1/2011 Wu ..... A63B 22/0235 482/54
2013/0237381 A1* 9/2013 Chen ..... A63B 22/02 482/54
2015/0051051 A1* 2/2015 Liu ..... A63B 22/02 482/54
2017/0106233 A1 4/2017 Yang
2021/0402279 A1* 12/2021 Luo ..... A63B 22/02
2023/0405396 A1* 12/2023 Hu ..... A63B 21/4035

* cited by examiner

*Primary Examiner* — Joshua Lee
*Assistant Examiner* — Catrina A Letterman

(57) ABSTRACT

A vertical-column folding mechanism for a treadmill is provided, including a treadmill frame body and a vertical column; where a first connector is arranged on the treadmill frame body; the first connector includes a first through hole; a connecting rod is arranged at the first through hole; one end of the connecting rod is provided with a handle in an eccentrically rotatable manner; a second connector is sleeved on the connecting rod; the vertical column is arranged on the second connector, and the vertical column and the second connector can synchronously rotate; a first locating piece is arranged on the second connector or the vertical column; a second locating piece cooperating with the first locating piece is arranged on the first connector or the treadmill frame body.

8 Claims, 5 Drawing Sheets

VERTICAL-COLUMN FOLDING MECHANISM FOR TREADMILL

TECHNICAL FIELD

The present disclosure relates to the technical field of treadmills, in particular to a vertical-column folding mechanism for a treadmill.

BACKGROUND

Folding treadmills have been all the rage in the market in recent years. A machine body of the treadmill is thin, and a vertical column can be folded and stored, which makes the treadmill take up a small space when it is not in use. The treadmills are very popular.

A folding mechanism of the existing folding treadmill is usually complicated in structure and inconvenient to operate. Therefore, it is necessary to improve the folding mechanism.

SUMMARY

For the shortcomings in the prior art, the present disclosure provides a vertical-column folding mechanism for a treadmill.

In order to solve the above technical problems, the present disclosure adopts the following technical solution:

A vertical-column folding mechanism for a treadmill includes a treadmill frame body and a vertical column; a first connector is arranged on the treadmill frame body; the first connector includes a first through hole; a connecting rod is arranged at the first through hole; one end of the connecting rod is provided with a handle in an eccentrically rotatable manner; a second connector is sleeved on the connecting rod; the vertical column is arranged on the second connector, and can rotate synchronously with the second connector; a first locating piece is arranged on the second connector or the vertical column; and a second locating piece cooperating with the first locating piece is arranged on the first connector or the treadmill frame body.

When the handle is rotated to enable the first locating piece and the second locating piece to cooperate and be connected with each other, the vertical column is limited.

In the above-mentioned technical solution, preferably, a mounting hole is formed in the treadmill frame body, and the first connector is fixedly arranged at the mounting hole.

In the above-mentioned technical solution, preferably, the other end of the connecting rod includes a stopper used for limiting a transverse movement range of the connecting rod.

In the above-mentioned technical solution, preferably, the stopper and the connecting rod are integrally formed, and a diameter of the stopper is greater than that of the first through hole.

In the above-mentioned technical solution, preferably, an elastic member is arranged on the connecting rod; one end of the elastic member resists against one wall of the second locating piece, and the other end resists against one wall of the second connector.

In the above-mentioned technical solution, preferably, the connecting rod includes a circular part and a non-circular part; the handle is eccentrically rotated at the non-circular part; the second connector includes a second through hole; the second through hole includes a first hole part matched with the circular part and a second hole part matched with the non-circular part; and the first hole part includes a first wall matched with the elastic member.

In the above-mentioned technical solution, preferably, the end of the handle connected to the connecting rod includes an outwards protruding part.

In the above-mentioned technical solution, preferably, the first locating piece includes several locating heads; the second locating piece includes several locating holes matched with the locating heads.

When the locating heads are snapped into the locating holes, the vertical column is limited.

In the above-mentioned technical solution, preferably, the second locating piece includes at least two groups of locating holes.

When the vertical column is unfolded, the locating heads are clamped to one group of locating holes in a fitted manner.

When the vertical column is folded, the locating heads are clamped to the other group of locating holes in a fitted manner.

In the above-mentioned technical solution, preferably, the first locating piece also includes a first limiting head; and the second locating piece includes a second limiting head used for limiting a motion range of the first limiting head.

The present disclosure has the beneficial effects.

The folding mechanism of the present disclosure has a simple and reasonable structure and is convenient to operate.

Due to the arrangement of the elastic member, it is convenient to quickly unlock the vertical column, so that the convenience of operation is improved.

The vertical column is reliably and firmly locked by the cooperation between the first locating piece and the second locating piece, and is prevented from swinging.

Due to the cooperation between the first limiting head and the second limiting head, it is convenient for a user to know a lock position of the vertical column, so that the convenience of operation is improved.

Due to the design of the two groups of locating holes, the vertical column can be locked in both its unfolded and folded states, so that damage caused by swinging of the vertical column in the folded state can be avoided.

DETAILED DESCRIPTION OF THE EMBODIMENTS

The present disclosure is further described in detail below in combination with specific implementations and accompanying drawings:

Referring to FIG. 1 to FIG. 5, a vertical-column folding mechanism for a treadmill includes a treadmill frame body 1 and a vertical column 2. There may be two vertical columns 2, which are respectively located on two sides of the treadmill frame body 1, that is, on two sides of a treadmill pedal, and specifically symmetrically disposed. The vertical columns are rotatable relative to the treadmill frame body or a treadmill body.

Figure 1:
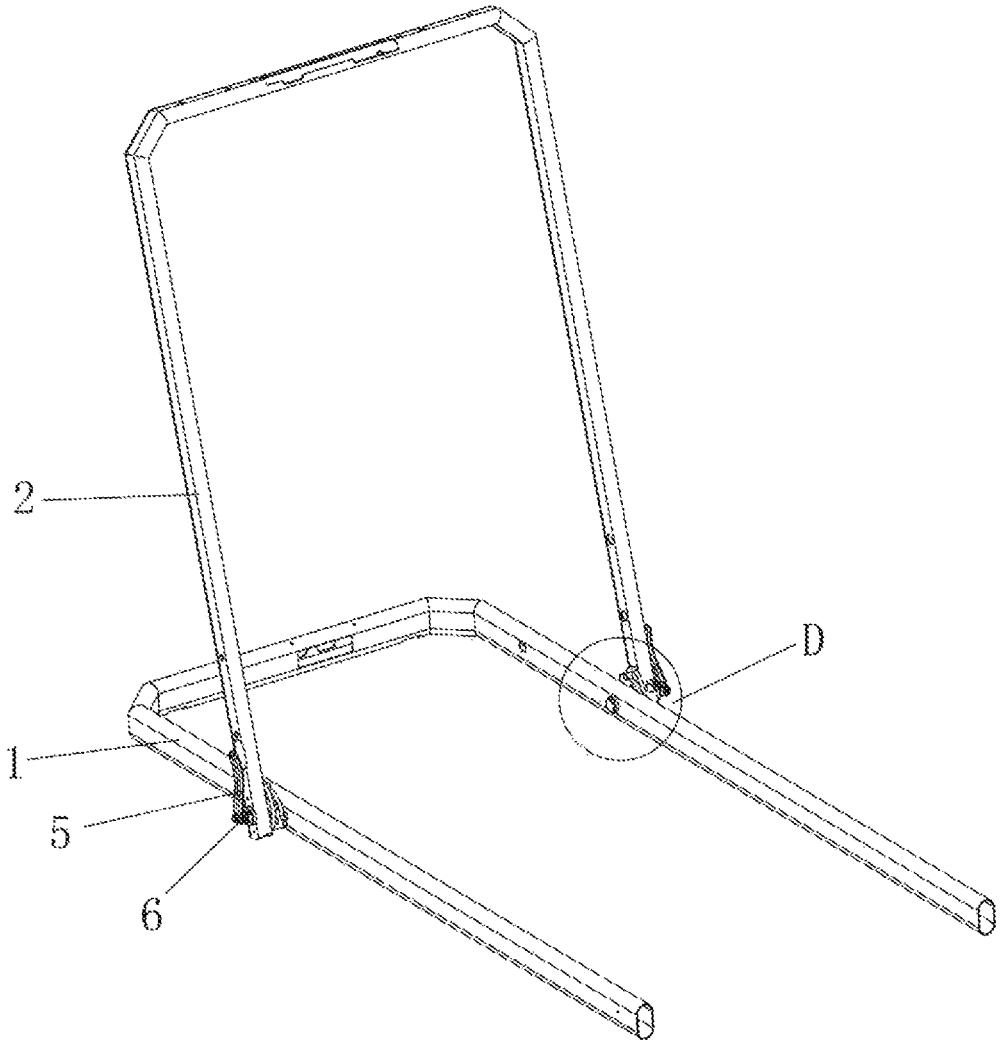
FIG. 1 is a schematic diagram of the present disclosure.
Figure 2:
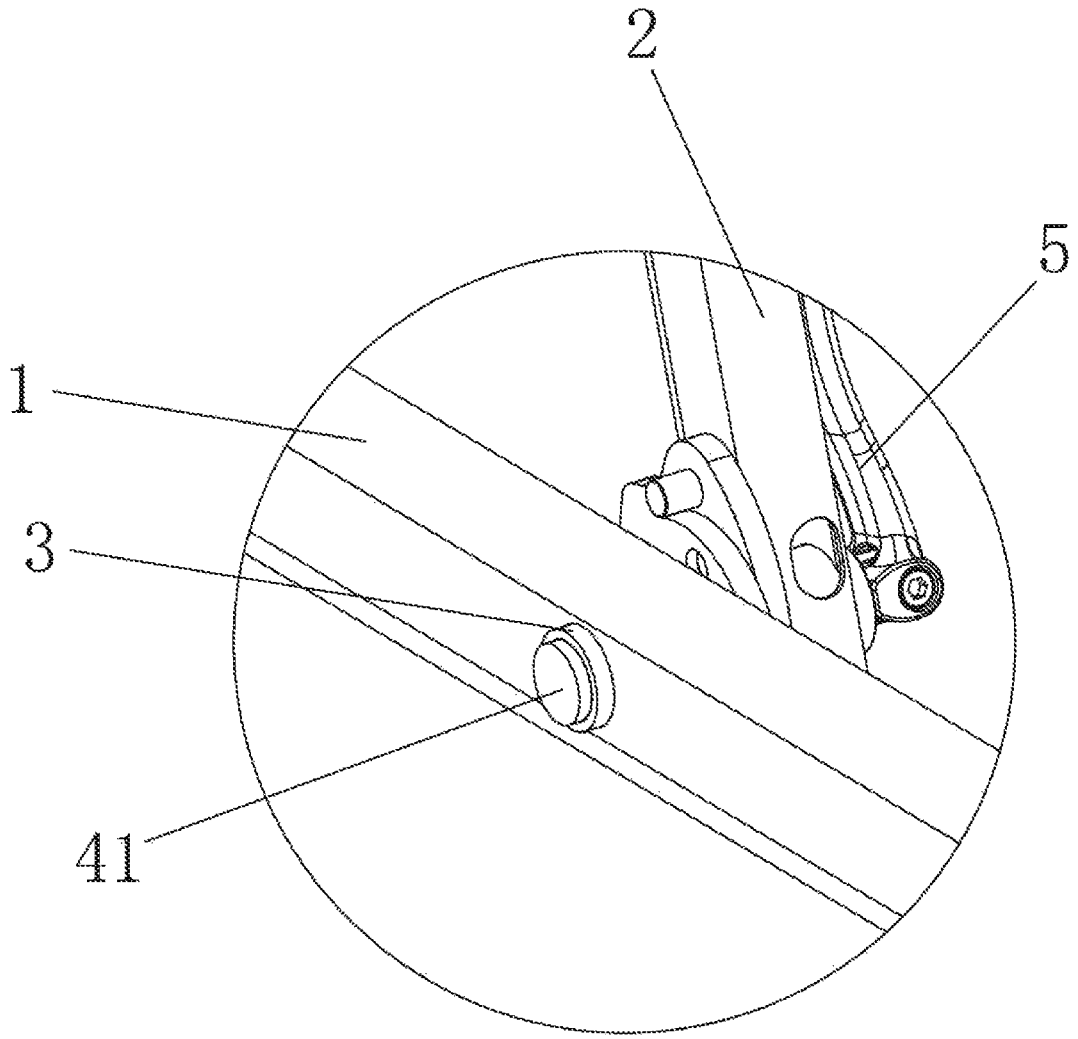
FIG. 2 is a schematic enlarged diagram of D in FIG. 1.

A first connector 3 is arranged on the treadmill frame body 1. In this embodiment, a mounting hole is formed in the treadmill frame body 1. The first connector 3 is fixedly arranged at the mounting hole. As shown in FIG. 1 and FIG. 2, the first connector 3 is fixedly arranged at the mounting hole in a penetrating manner.

The first connector 3 includes a first through hole 31. An outer wall of the first connector 3 and the first through hole 31 may be both circular. A connecting rod 4 is arranged at the first through hole 31. The connecting rod 4 may axially move along the first through hole 31. The connecting rod 4 has a shape matched with that of the first through hole 31 and may be a corresponding cylinder.

One end of the connecting rod 4 located at the first connector 3 includes a stopper 41 used for limiting a transverse movement range of the connecting rod 4. The stopper 41 and the connecting rod 4 may be integrally formed, and has a diameter greater than that of the first through hole 31.

A handle 5 is arranged at the other corresponding end of the connecting rod 4 in an eccentrically rotatable manner. The handle 5 may be an eccentric handle. The end of the handle 5 connected to the connecting rod 4 includes an outwards protruding part 51. A second connector 6 is sleeved on the connecting rod 4. The vertical column 2 is arranged on the second connector 6, and can rotate synchronously with the second connector. In this embodiment, the corresponding vertical column 2 and the corresponding second connector 6 are relatively fixed.

A first locating piece 7 is arranged on the second connector 6 or the vertical column 2. Specifically, the vertical column 2, the second connector 6 and the first locating piece 7 move synchronously.

A second locating piece 8 matched with the first locating piece 7 is arranged on the first connector 3 or the treadmill frame body 1. The second locating piece 8 and the treadmill frame body 1 or the first connector 3 are relatively fixed. The first connector 3, the treadmill frame body 1 and the second locating piece 8 can be set to be stationary, and the actions of the vertical column 2, the second connector 6 and the first locating piece 7 achieve unfolding, locating and folding of the vertical column.

There may be various cooperation structures for the first locating piece 7 and the second locating piece 8. One cooperation manner is specifically described in this embodiment.

Figure 3:
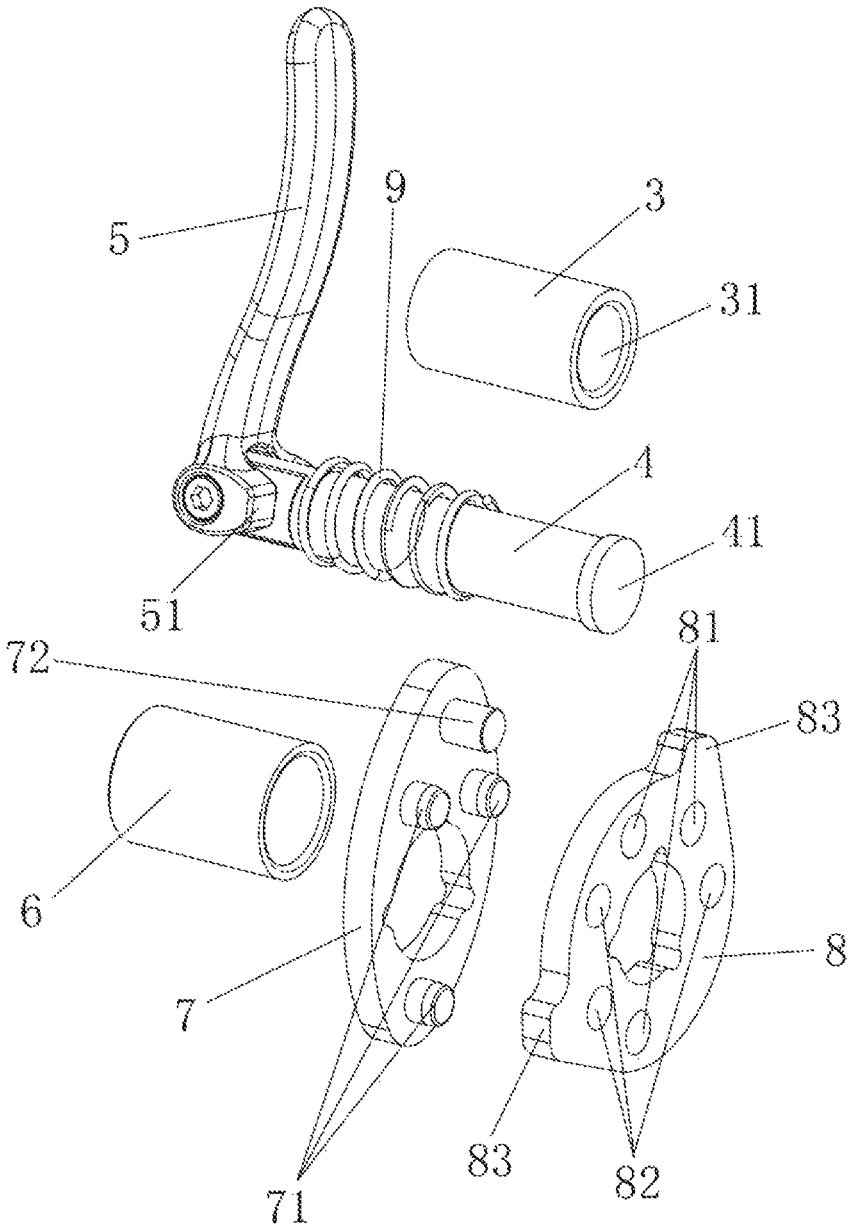
FIG. 3 is a schematic exploded diagram of the present disclosure.
Figure 4:
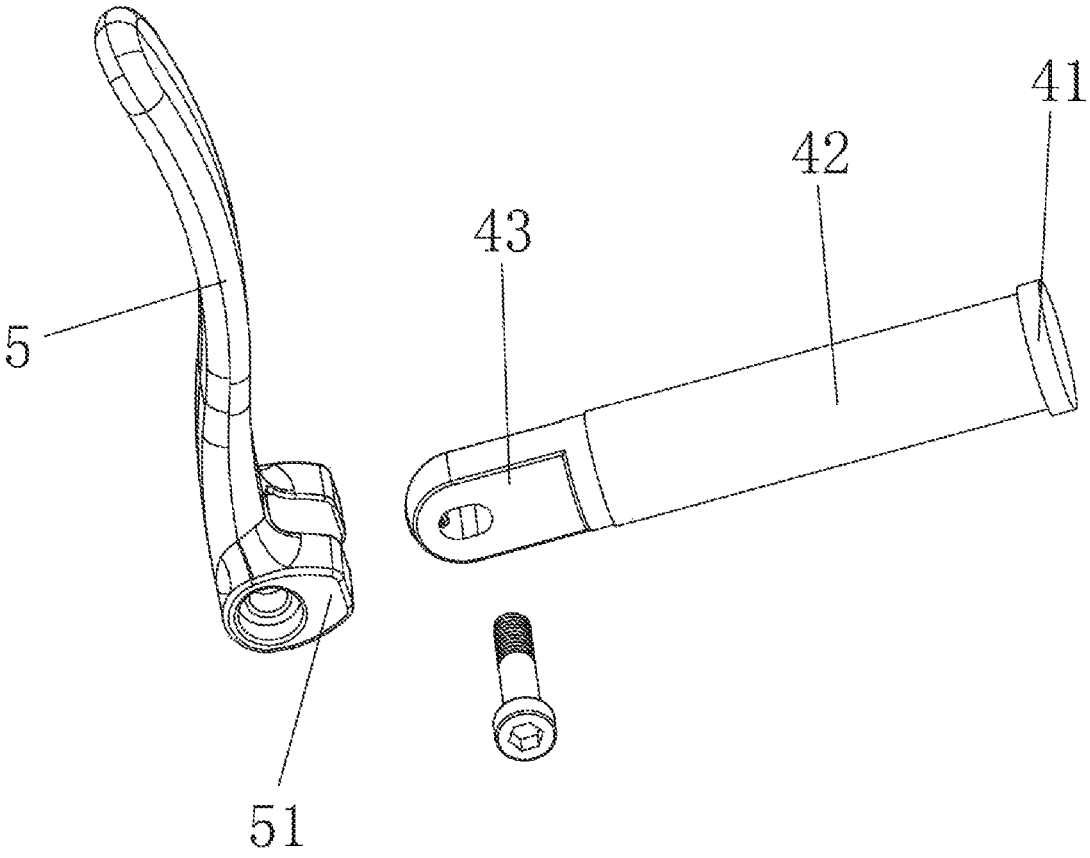
FIG. 4 is a schematic exploded diagram of a handle and a connecting rod of the present disclosure.

As shown in FIG. 3, the first locating piece 7 includes several locating heads 71, and the second locating piece 8 includes several locating holes matched with the locating heads 71. When the locating heads 71 are snapped into the locating holes, the vertical column 2 is limited.

In order to achieve limitation in both states where the vertical column is unfolded and folded, the second locating piece 8 includes at least two groups of locating holes. When the vertical column 2 is unfolded, the locating heads 71 are clamped to the locating hole group a81 in a fitted manner; and when the vertical column 2 is folded, the locating heads 71 are clamped to the locating hole group b82 in a fitted manner.

There may be three locating heads which are disposed on the first locating piece 7 in a triangular distribution manner to improve the stability of locating. Correspondingly, there are three locating holes in one group, and the setting orientation of the locating holes is fitted to that of the locating heads 71.

Corresponding through holes are formed in both the first locating piece 7 and the second locating piece 8, so as to facilitate assembling of the first locating piece 7 and the second locating piece 8.

As shown in FIG. 3, in order to enable a user to know a locking position of the vertical column, the first locating piece 7 also includes a first limiting head 72, and the second locating piece 8 includes a second limiting head 83 used for limiting a motion range of the first limiting head 72. Specifically, there are at least two second limiting heads 83, one of which is used for limiting the vertical column 2 during unfolding and the other one of which is used for limiting the vertical column 2 during folding. The second limiting heads 83 may be integrally formed on the second locating piece 8, or are formed by extending from an outer wall of the second locating piece 8 towards an outer side of the second locating piece 8. A surface of each second limiting head 83 that is in contact with the first limiting head 72 may be designed to be an arc surface. Correspondingly, the first limiting head 72 may be adaptively designed to be cylindrical.

In order to facilitate the resetting of the vertical column 2 and facilitate the rotation of the reset vertical column 2, an elastic member 9 may be arranged on the connecting rod 4. The elastic member 9 can be a spring. Specifically, one end of the elastic member 9 resists against one wall of the second locating piece 8, and the other end resists against one wall of the second locating piece 6.

Figure 5:
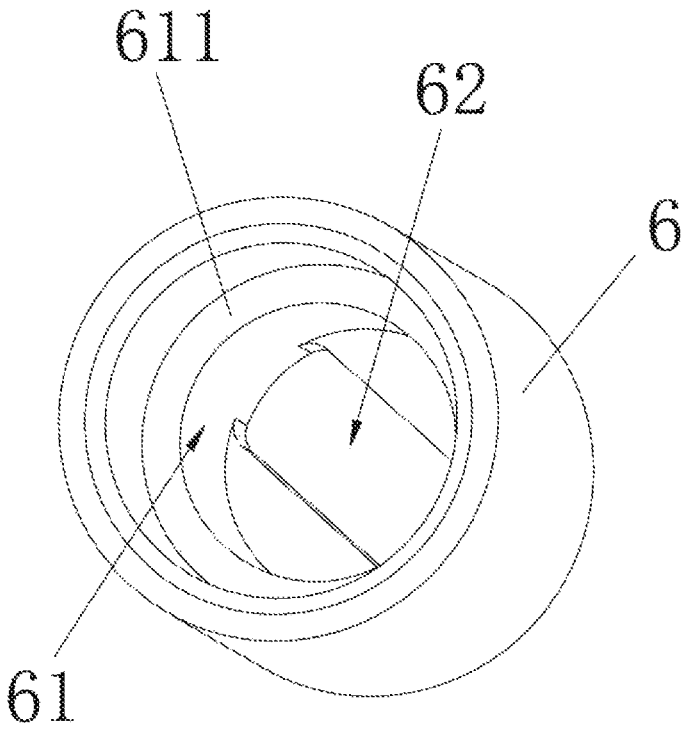
FIG. 5 is a schematic diagram of a second connector of the present disclosure.

The connecting rod 4 includes a circular part 42 and a non-circular part 43. The handle 5 is eccentrically rotated at the non-circular part 43. As shown in FIG. 5, the second connector 6 includes a second through hole; the second through hole includes a first hole part 61 matched with the circular part 42 and a second hole part 62 matched with the non-circular part 43; and the first hole part 61 includes a first wall 611 matched with the elastic member 9.

During specific use, unlocking is achieved by rotating the handle 5. In this embodiment, the handle 5 is flipped towards the outer side to achieve unlocking. At this time, the first locating piece 7 and the second locating piece 8 are separated. After unlocking, the vertical column 2 is rotated. When the vertical column 2 is rotated until the first limiting head 72 is in contact with the second limiting head 83 used during unfolding, it indicates that the vertical column 2 has been rotated in place. At this time, the handle 5 is flipped towards the inner side to achieve locking. At this time, the first locating piece 7 and the second locating piece 8 cooperate and are connected with each other. In locking, the outwards protruding part 51 of the handle 5 resists against the second connector 6, the elastic member 9 retracts, and the handle 5 and the connecting rod 4 are relatively vertical to each other or relatively tend to be vertical.

Meanwhile, in order to improve the convenience of use by a user, the position of the second limiting head 83 used during unfolding of the vertical column 2 may be set as follows: the first limiting head 72 is in contact with the second limiting head 83 only after the vertical column 2 is unfolded by more than 90 degrees, as shown in FIG. 1.

The corresponding vertical column 2 correspondingly has the entire structure as shown in FIG. 3, so that the overall locating stability of the vertical column 2 is improved.

The above embodiments are only used to describe the technical solutions of the present disclosure, and not intended to limit the present disclosure. Although the present disclosure has been described in detail with reference to the foregoing embodiments, those ordinarily skilled in the art should understand that they can still modify the technical solutions described in all the foregoing embodiments, or equivalently replace some of the technical features, and these modifications or replacements do not depart the essences of the corresponding technical solutions from the spirit and scope of the technical solutions of all the embodiments of the present disclosure.

What is claimed is:

1. A vertical-column folding mechanism for a treadmill, comprising a treadmill frame body and a vertical column, wherein a first connector is arranged on the treadmill frame body; the first connector comprises a first through hole; a connecting rod is arranged at the first through hole; one end of the connecting rod is provided with a handle in an eccentrically rotatable manner; a second connector is sleeved on the connecting rod; the vertical column is arranged on the second connector, and can rotate synchronously with the second connector; a first locating piece is arranged on the second connector or the vertical column; a second locating piece cooperating with the first locating piece is arranged on the first connector or the treadmill frame body;

when the handle is rotated to enable the first locating piece and the second locating piece to cooperate and be connected with each other, the vertical column is limited;

wherein an elastic member is arranged on the connecting rod; one end of the elastic member resists against one wall of the second locating piece, and the other end resists against one wall of the second connector;

wherein the connecting rod comprises a circular part and a non-circular part; the handle is eccentrically rotated at the non-circular part; the second connector comprises a second through hole; the second through hole comprises a first hole part matched with the circular part and a second hole part matched with the non-circular part; and the first hole part comprises a first wall matched with the elastic member.

2. The vertical-column folding mechanism for the treadmill according to claim 1, wherein a mounting hole is formed in the treadmill frame body, and the first connector is fixedly arranged at the mounting hole.

3. The vertical-column folding mechanism for the treadmill according to claim 1, wherein the other end of the connecting rod comprises a stopper used for limiting a transverse movement range of the connecting rod.

4. The vertical-column folding mechanism for the treadmill according to claim 3, wherein the stopper and the connecting rod are integrally formed, and a diameter of the stopper is greater than that of the first through hole.

5. The vertical-column folding mechanism for the treadmill according to claim 1, wherein the end of the handle connected to the connecting rod comprises an outwards protruding part.

6. The vertical-column folding mechanism for the treadmill according to claim 1, wherein the first locating piece comprises several locating heads; the second locating piece comprises several locating holes matched with the several locating heads;

when the several locating heads are snapped into the several locating holes, the vertical column is limited.

7. The vertical-column folding mechanism for the treadmill according to claim 6, wherein the several locating holes of the second locating piece comprise at least two groups of locating holes;

when the vertical column is unfolded, the locating heads are clamped to a first group of locating holes of the at least two groups of locating holes in a fitted manner;

when the vertical column is folded, the locating heads are clamped to a second group of locating holes, different from the first group of locating holes, of the at least two groups of locating holes in a fitted manner.

8. The vertical-column folding mechanism for the treadmill according to claim 1, wherein the first locating piece also comprises a first limiting head; and the second locating piece comprises a second limiting head used for limiting a motion range of the first limiting head.

* * * * *